United States Patent [19]

Anderson

[11] Patent Number: 5,038,656

[45] Date of Patent: Aug. 13, 1991

[54] GROOVE TUBE KEY MOUNTING FOR MUSICAL INSTRUMENTS

[76] Inventor: Thomas M. Anderson, Box 284, H.C. 70, Mountain View, Ark. 72560

[21] Appl. No.: 484,233

[22] Filed: Feb. 22, 1990

[51] Int. Cl.[5] ..... G10D 9/04

[52] U.S. Cl. ..... 84/380 R

[58] Field of Search ..... 84/380–385

[56] References Cited

U.S. PATENT DOCUMENTS

| | | | |
|---|---|---|---|
| 2,234,093 | 3/1941 | Silver | 84/380 R |
| 2,744,435 | 5/1956 | Anderson et al. | 84/380 R |
| 3,145,610 | 8/1964 | Anderson et al. | 84/380 R |

*Primary Examiner*—Lawrence R. Franklin
*Attorney, Agent, or Firm*—Boyd D. Cox

[57] ABSTRACT

This device provides simplified, effective and inexpensive constructions for transferring energy stored in torque springs (30) to the function of keys, valves, rings and levers of musical instruments. It is a rigid tube indented with a longitudinal groove (12) designed to serve as an axle supporting key mechanisms between permanent posts anchored to the body of a musical instrument. After groove tube (10) is passed through forward post (18*a*), it is introduced into key tubing (14), groove (12) tracks over bump or protuberance (28) in key tubing (14) and groove tube (10) proceeds into back permanent post (18*b*) where it rests. Groove tube (10) is now journalled fore and aft in permanent posts (18*a*) and (18*b*). In like process, groove tube (10) fills the hollow of key rod (16) and is journalled in forward post (18*a*). The solid end of key rod (16) is pivoted at rear post (18*b*). This system permits lengthwise movement, but prevents rotation of groove tube (10) within key tubing (14) or key rod (16). The same groove (12) in groove tube (10) manifests itself as a ridge along the interior of groove tube (10). This elevation obstructs the rotation of hook (34) of torque spring (30).

20 Claims, 1 Drawing Sheet

GROOVE TUBE KEY MOUNTING FOR MUSICAL INSTRUMENTS

BACKGROUND OF THE INVENTION

1. Field of the Invention

This invention relates to an improved and simplified method for mounting keys, pads, rings and valves on wind instruments such as saxophones, clarinets, flutes, piccolos, oboes, English horns, bassoons and the like.

2. Description of the Prior Art

U.S. Pat. Nos. 2,744,435 and 3,145,610 are related to the present application.

Musical instruments of this type are generally referred to as woodwind instruments. They are tubes penetrated at predetermined points with holes. These holes can be covered or uncovered with the fingers or thumbs or associated padded keys. The sequence in which these holes are closed or opened determines the pitch of the instrument.

The padded keys associated with these holes, known as tone holes, must be forced into an open or closed position by spring tension. To do this, an internally mounted torque spring is used as described in U.S. Pat. No. 2,744,435: Apparatus for mounting keys, pads and the like of musical instruments, issued May 8, 1956, to T. M. Anderson et al.

U.S. Pat. No. 3,145,610 relates to a device which provides means by which tension of the torque spring could be selectively increased or decreased by an automatic locking system. This patent was issued to T. M. Anderson et al Aug. 25, 1964.

Past applications of the torque spring principle have involved the use of a number of parts. This added to the complexity of the key mounting structure. These several parts did nothing to enhance the advantages of the internally mounted torque spring. The complexity of the applications made the unit more susceptible to damage by trauma. The repairs required to restore the instrument to playing condition proved time consuming and costly. The complicated device in previous applications was vulnerable and even delicate.

SUMMARY OF THE INVENTION

It has been an object of the present invention to simplify and strengthen the unit. A prime consideration has been to eliminate the number of operations required for the torque spring application.

The present invention also provides the repairman with a device which is simple and inexpensive. With this invention repairs can be made with a minimum of operations and effort.

Another advantage of the groove tube is the simplicity and ease with which a mechanic can make conversions. Traditionally sprung instruments and those with earlier torque springs may be easily converted with the groove tube.

An advantage of the groove tube is that it is easily and inexpensively manufactured. It is a simple cylinder having a straight longitudinally indented groove end to end. Extrusion, stamping or molding are some means of manufacturing. The size, depth and width of the groove are arbitrary dimensions. These dimensions will be effective within broad limits. This is clearly an advantage.

Another advantage is the wide choice of materials from which the groove tube may be manufactured. Some possibilities would be metal, plastic, ceramics, fiberglass or any other substance which could provide rigidity and durability.

It is also an advantage of the groove tube that more than one groove could be incorporated into its design. This is a possible alternative, though not a necessary one.

The groove tube will also accommodate the use of flat stock in its manufacture. If flat stock is used, the result will be an opening or slit along the length of the tube. This slit can become part of the tube or of the groove without detracting from its function. This is another advantage.

It is also an advantage that preparation of the key mounting structure on the instrument requires only two mechanical functions. These are the placing of one uniform sized bore through key tubing or rod, and supporting posts, plus the formation of a small protuberance inside the key rod or tube.

This latter advantage includes the benefit of requiring fewer tools. The required tools are standard, cheap and readily available.

When the groove tube invention has been incorporated into a woodwind instrument it is invisible. There are no small separate parts or mechanical appurtenances required. Periodic lubrication is unnecessary. These are added advantages.

Also advantageous is the ease with which the entire groove tube assembly may be disassembled. It is characteristic of woodwind instruments that the pads periodically need replacement. This may refer to a single pad or to many or all pads. Any mechanical repairs, cleaning or polishing are greatly facilitated as well, by the ease of dismantling the groove tube invention.

It is customary for manufacturers of woodwind instruments to seal all pads against the tone holes which they cover. This means that all keys are wrapped with ribbon. This ribbon surrounds the instrument forcing all key pads into close contact with the tone hole rims they meet. As the ribbon is drawn tight, a ridge is formed in the soft pad. This ridge improves the seal making a better valve. While in storage, prior to selling, the ribbons remain in place. When the instrument is sold the ribbon is removed. This leaves an indented circular ridge near the edge of each pad. The rim of the tone hole seats in the circular indentation of the pad when the key is closed. This snug seating precludes the leaking of air through the tone hole. This air tight seal is necessary for proper performance of the instrument. In the present invention the practice of tying down pads is eliminated. The force of the torque spring can be used to keep the pad forced against the tone hole rim while the instrument is in storage. This is yet another advantage of this system.

The object of the groove tube invention is to provide a means by which the torque spring can be easily, inexpensively, firmly and durably mounted in keys of woodwind instruments. Further objectives and advantages will be evident from a consideration of the following drawings and descriptions.

DESCRIPTION OF THE PREFERRED EMBODIMENTS

Reference Numerals in Drawings

Figure 1:
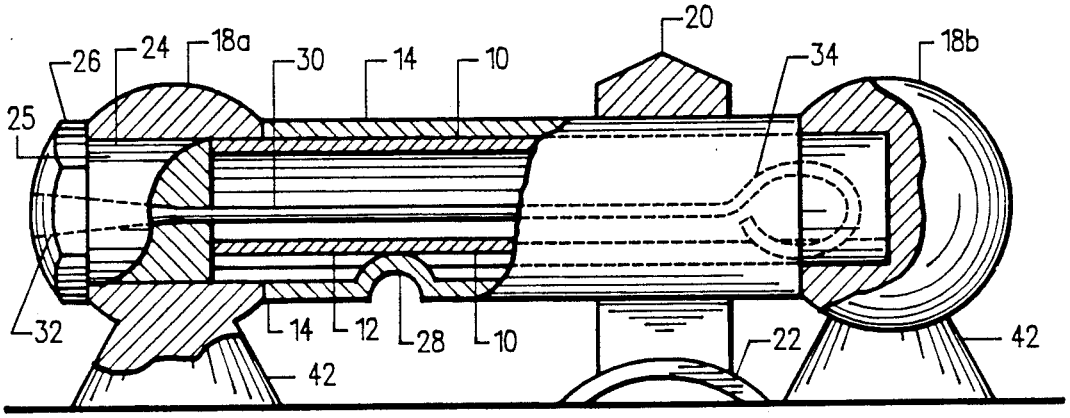
FIG. 1 shows the groove tube as an axle supported by close together posts.

10 GROOVE TUBE
12 GROOVE OF GROOVE TUBE
14 KEY TUBING
16 KEY ROD
18*a* FRONT POST
18*b* REAR POST
20 KEY LEVER
22 KEY VALVE PAD AND CUP
24 STEM OF STUD
25 STUD
26 HEX HEAD OF STUD
28 DIMPLE AND BUMP
30 TORQUE SPRING
32 FLATTENED END OF TORQUE SPRING
34 HOOKED END OF TORQUE SPRING
36 PIVOT STUD
38 PIVOT
40 THREADED HOLE IN PIVOT STUD
42 BASE OF POST

In woodwind construction, there are two basic methods of key mountings. Both provide the means to cover or uncover tone holes by finger movement. When a tone hole is covered or sealed shut, that portion of the instrument tubing is extended to the next open tone hole. Conversely, when a tone hole is opened or uncovered, the closed length of the key tubing ends at that point. Therefore, by opening and closing tone holes, the instrument tubing can be selectively shortened or lengthened. When the closed tube is lengthened, the vibrating air column produces a lower pitch; when shortened the pitch is higher. Thus, by covering or uncovering tone holes, the pitch of the instrument can be varied. By placing the tone holes at scientifically arranged points, the pitch of the instrument can be altered sequentially. This produces different notes and ultimately music.

The two methods of mounting keys on woodwind instruments are based on the distance between the two mounting posts. Keys are affixed to an axle which is suspended between two stationary posts. When the posts are close enough, a hollow axle is supported by a single unit which penetrates both posts. When the posts are far apart, a solid axle is pivoted at both posts. The axle, the fulcrum of the key structure, is a rod or tube which mounts a radially extended cup and pad. The cup is a flattened disc with a shallow rim which holds the soft pad. A finger key is also radially mounted to the same rod or tube. This controls the movement of the pad. The cup and associated pad are held in open or closed position by the force of the torque spring. This torque spring is the subject of a patent noted above as U.S. Pat. No. 2,744,435.

The groove tube invention, with its few parts, eliminates much of the friction caused by earlier mountings. Its quiet, sensitive movement gives the player an affinity with the instrument never before realized.

Referring to the drawings, a manner of using this invention will be diagramed. This does not preclude variations of this application.

In FIG. 1, the drawing represents a method of applying the invention, the groove tube 10, to the type of key mounting in which the stationary posts, 18*a* and 18*b*, are close together. The key tubing 14 is supported between posts 18*a* and 18*b* by a rigid axle 10, the groove tube. The key tubing 14 and the posts, 18*a* and 18*b*, are penetrated through their centers by a hole of uniform size. The groove tube 10 will pass through this aperture in a close fit. In the bottom aspect of the key tubing 14, that portion of the key tubing 14 which faces the body of the instrument, a dimple 28 is punched, stamped or pressed. The resulting depression in the key tubing 14 produces a bump or protuberance 28 in the interior surface of key tubing 14. The location of this boss 28 is arbitrary and can conform to the mechanical and aesthetic advantages of the application without detracting from its function. This small protuberance 28 is calculated to conform to groove 12 of groove tube 10. When the groove tube 10 is passed into the mounting structure through post 18*a* into and through key tubing 14 and into post 18*b*, the groove 12 is tracked over the small protuberance, the bump 28. The groove 12, thus containing the protrusive bump 28, is prevented from rotating within the key tubing 14. Though rotation is not possible, the groove tube 10 may be slid longitudinally. This provides simple insertion or withdrawal of groove tube 10 in or from the key structure. After assembly then, when key tubing 14 is rotated by pressure on key lever 20, groove tube 10 is constant with that rotation. Key 20, pad 22, key tubing 14 and groove tube 10 all move uniformly at the command of the player's finger.

In FIG. 1, the ends of key tubing 14 meet the interior facing surfaces of posts 18*a* and 18*b*. Groove tube 10, passing through post 18*a*, through key tubing 14 while groove 12 accommodates bump 28, rests in the cylindrical opening of post 18*b*. The extending portions of groove tube 10 are journals in the bearing surfaces of posts 18*a* and 18*b*.

Descriptions in this document refer to groove 12 in groove tube 10. This is an indentation in the exterior of groove tube 10. It is a ridge on the interior surface of groove tube 10.

Groove tube 10 supports the entire key structure. This includes key tubing 14, key lever 20 and pad 22 in a freely rotating relationship with stationary posts 18*a* and 18*b*.

The opening in post 18*a*, accommodating the end of groove tube 10, extends only part way into the solid post 18*b* as illustrated. However that opening may completely penetrate post 18*b*. This will not interfere with the function of groove tube 10.

In FIG. 1, stud 25 is confined in the cylindrical canal of 18*a* by a press fit. Stem 24 of stud 25 must be forcibly inserted into the chamber of post 18*a*. The press fit secures stud 25 against any rotational or longitudinal forces exerted by key action. This frictional method of anchoring stud to post is the subject of a separate patent application by T. M. Anderson.

In FIG. 1, torque spring 30 is round piano wire. One end of this wire is flattened. When drawn through a suitable center hole in stud 25, the spring wire becomes permanently wedged in place. The torque spring 30 becomes an integral part of stud 25. The opposite end of this wire at an appropriate point is hooked or bent into an eye 34. The width of the eye matches the inside diameter of groove tube 10. Groove 12, an interior ridge in groove tube 10, will interfere and obstruct rotation of eye 34.

Figure 2:
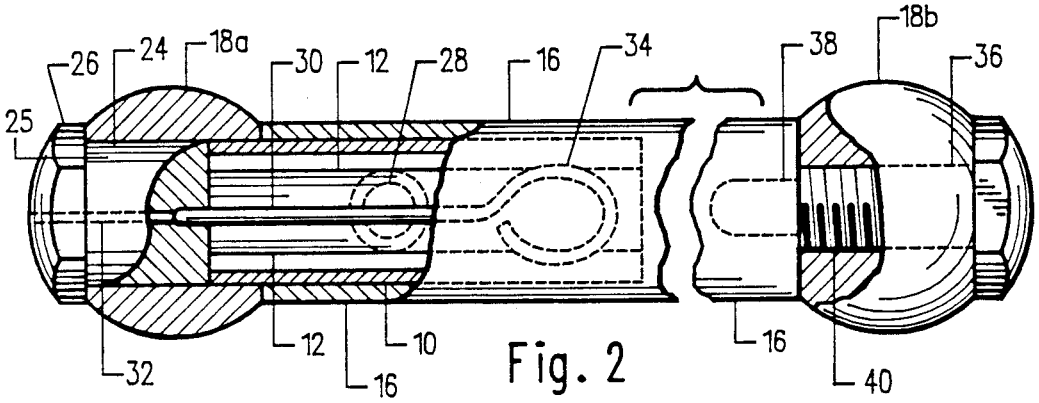
FIG. 2 shows the groove tube as a pivot in one of two far apart posts.

In FIG. 2, partly in section, the diagram is from the superior aspect. This delineates the invention as it is applied to "long" keys. The posts supporting, these long keys are too far apart to accommodate a single axle within a hollow tube. In this mount the length of the long rod separates the key lever from the key cup and pad.

In FIG. 2, the post 18b represents the rear or back post. This terminology simply describes the post opposite the post into which the groove tube 10 is introduced.

Post 18b is drilled and tapped to accommodate threaded stud 36. Pivot 38 projects from stud 36. When stud 36 is screwed into threaded hole 40, pivot 38 adapts to the matched recess centered in rod 16.

The forward end of key rod 16 is drilled to a given depth. The depth of this bore is arbitrary. It is calculated to accept groove tube 10 in a sliding close fit. The groove 12 will track over protuberance 28 and rest against the blind end of the bore in rod 16. A portion of groove tube 10 will extend beyond the end of rod 16. This will be the journal which supports the rotation of groove tube 10 in the post 18a bearing. The bore in the center of rod 16, after the dimple 28 has been indented, will be a copy of tubing 14. The diameter of the bore will be identical and the protuberance may be placed with similar latitude. The exception will be the depth of the bore. This dimension will conform to the demand of the key involved. Other than its length, the groove tube 10 with groove 12 can serve the demands of all keys.

When the groove tube 10 is tracked over the projection 28 into the bore of key rod 16 to its blind end, the groove tube 10 becomes rigid with key rod 16. Though groove tube 10 may be moved transversely, rotation is not possible in key rod 16. When the key rod 16, with its mounted key lever, pad and cup, is placed between the forward and rear posts, 18a and 18b, it is held in permanent position by pivot 38 and the journal of groove tube 10. Key rod 16 is placed in the proper position. Pivot 38 enters the cavity in rod 16 when stud 36 is screwed into rear post 18b. Groove tube 10 is passed through the center hole of post 18a and into the bore of key rod 16. After groove 12 slides over bump 28, groove tube 10 comes to rest against the blind end of the bore in key rod 16. With this part of the assembly completed, key rod 16 with its associated key and cupped pad will freely rotate. The pivot 38 and the groove tube 10 will be the journals at posts 18a and 18b.

Rotating this assembled unit will cause the pad to seat or withdraw from its associated tone hole rim. In effect, this opens or closes the tone hole.

In FIG. 2, the stud 25, with its associated hex head 26 and stem 24, is anchored to post 18a in a press fit relationship. This union is exactly the same as that described in FIG. 1, and involves stud 25 of uniform dimensions.

In FIG. 2, the torque spring 30, flattened end 32 and the hook or eye 34, are united with stud 25 using the identical method employed for the stud 25 and spring 30 in FIG. 1.

Figure 3:
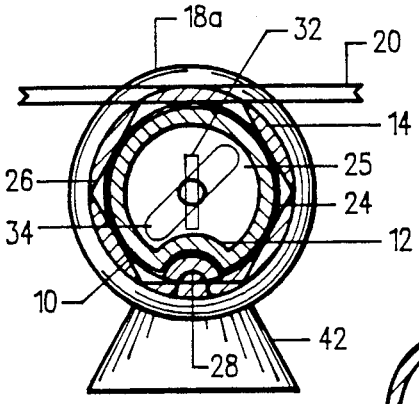
FIG. 3 shows the cross section of the groove tube application from a front post.

FIG. 3 is a cross sectional view of the groove tube application as seen from the forward end of the forward post 18a. The key tubing or the wall of the hollow end of the key rod is diagramed at 14. The protuberance or bump which is punched into the tubing or hollow rod nearest the instrument body is depicted at 28. The cross section of the groove tube is identified by the number 10. The cross sectional aspect of the groove is numbered 12. It will be observed that groove 12 adapts to protuberance 28. The mating of protuberance 28 and groove 12 precludes rotation of groove tube 10 within key tubing or hollow rod 14. Therefore, any force rotating groove tube 10 will rotate key tubing or rod 14 and attached lever 20. Lever 20 represents any keys or pads associated with key tubing or rod 14. The interior end of torque spring 30, the hooked or bent end, is identified in FIG. 3 as 34. The torque spring 30 is locked into the stem 24 of stud 25 when flattened end 32 is forcibly drawn into stud center hole in a wedging fit. In this way, torque spring 30 becomes an integral part and is constant with stud 25. In FIG. 3, stud head 26 is flush with the exterior shoulder of post 18a. The base of post 18a is 42. It is anchored to the body of the instrument.

Figure 4:
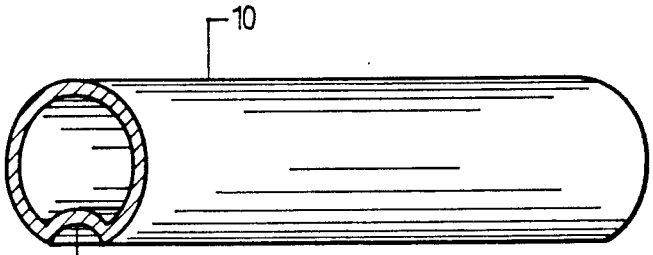
FIG. 4 shows a perspective view of the groove tube.

FIG. 4 is a perspective view of groove tube 10. Groove 12 is depicted along the lower perimeter of groove tube 10. The dimensions of groove 12 are arbitrary. It must be designed to accommodate the protuberance 28 in FIGS. 1, 2, and 3. The contour of the cross section of groove 12 may be in the form of a "U", a "V" or other configuration. The purpose is simply to interlock with protuberance 28. The bump or protuberance may be a cone, a hemisphere or other shape which can mate with groove 12. Groove tube 10 is a cylindrical tube. Groove 12 extends the length of groove tube 10. This configuration, the presence of a groove in a tube, increases the strength and rigidity of groove tube 10. Groove tube 10 may be fabricated of metal, plastic, fiberglass, ceramics or any other composition which will provide the shape, rigidity and bearing surfaces necessary to its function.

Of all woodwinds, the clarinet is the most used. In the western world, more clarinets are sold than any other woodwind instrument.

The most common key arrangement used on contemporary clarinets is referred to as 17-6. This means that there are 17 keys and 6 rings. The invention, as it is described here, can be applied to 16 of those keys and to all the rings. In the one exception two keys are conventionally mounted on a single axle. This system is not used by all manufacturers. In those cases this invention can be applied to all keys.

All keys on clarinets, saxophones, flutes, piccolos, oboes, English horns and bassoons are mounted according to traditional standards. These are based on aesthetic as well as mechanical considerations. This invention, groove tube 10, can be incorporated into the entire woodwind family. The complete unit, groove tube 10, is inexpensive and simple. With groove tube 10, keys can be lowered. This makes it possible to redesign woodwinds, which many feel is overdue.

General outline of the operation of groove tube

The basic function of a groove tube is to transfer stored energy of a torque spring to the use of keys, pads and rings of musical instruments.

A groove tube will serve this purpose in all cases in which two stationary posts support a key, pad or ring axle.

As illustrated, turning hex head 26 clockwise or counterclockwise will urge torque spring 30 in like direction.

With key tubing 14 (or key rod 16) as fulcrum, radially mounted pad 22 is impelled to maintain an open or closed position over its mated tone hole.

This static position is overcome by finger pressure on key 20, causing pad 22 to arc against or away from the rim of the mated tone hole.

As the fingers and thumbs, in like manner, manipulate the keys of the musical instrument, the tonal pitch is lowered or elevated. This produces music.

Conclusions, Ramifications and Scope of Invention

The groove tube (10) provides a stable, inexpensive and effective link between the active forces of torque springs (30) and the function of keys, valves, rings and levers of musical instruments.

The descriptive analysis articulated here is but one application of this concept. Other variations are available within the scope of the invention.

A groove tube formed of flat stock is an example. The margins closing the circumference will form an open groove, a longitudinal slit with raised edges. An oversize perimeter would prescribe a compression fit in key tubing (14) or key rod (16).

The length of groove tube (10) will determine the bearing surface in permanent posts (18*a*) and (18*b*). Friction can be minimized to improve action.

If groove (12) in groove tube (10) encompasses some degrees of the circumference of groove tube (10), twisting in its passage from end to end, the resulting groove (12) will be a helix. Rotational force with this configuration will cause the bump or protuberance (28) to exert end pressure on groove tube (10). This eliminates end or side play.

A recessed ball bearing or an insert in key tubing (14) or key rod (16) will create protuberance or bump (28).

By fixing the free end of torque spring (30) in groove tube (10): stud (25), torque spring (30), and groove tube (10) become a single compound unit.

I claim:

1. In a musical instrument having at least one tone hole together with a pair of stationary posts disposed in spaced relation and being adapted for mounting of a key in pivotal relation to said tone hole, inner and outer tubular members, said key connected to said outer tubular member, a tensioning member within said inner tubular member operably connected for biasing said key in a normally closed relation with said tone hole, the improvement comprising:

means mounting and securing said inner and outer tubular members for concurrent reciprocal rotation about a longitudinal axis between said posts.

2. In a musical instrument according to claim 1, wherein said inner tubular member is disposed within said outer tubular member.

3. In a musical instrument according to claim 1, wherein said inner and outer tubular members are substantially concentric cylinders.

4. In a musical instrument according to claim 1, further comprising means for constraining said inner and outer tubular members against relative rotation, while permitting relative axial movement of said inner and outer tubular members.

5. In a musical instrument according to claim 4, further comprising an axially extending groove in one of said inner and outer tubular members and a projection on the other of said inner and outer tubular members, said projection received in said groove.

6. In a musical instrument according to claim 5, wherein said groove extends along an exterior surface of said inner tubular member and said projection extends inwardly from an interior surface of said outer tubular member.

7. In a musical instrument according to claim 6, wherein said tensioning member comprises a torsion spring disposed substantially within said inner tubular member.

8. In a musical instrument according to claim 7, wherein said groove forms a radially inwardly projecting ridge within said inner tubular member, said projecting ridge disposed in at least partial abutment with said torsion spring to inhibit relative rotation between said torsion spring and said inner tubular member.

9. In a musical instrument according to claim 8, further comprising a stud, means for adjustably securing said stud to one of said posts, means securing one end of said torsion spring to said stud, whereby tension of said torsion spring may be adjusted by manual manipulation of said stud.

10. In a musical instrument according to claim 9, wherein said stud is adjustably rotatable to adjust tension of said torsion spring.

11. In a musical instrument according to claim 8, wherein said torsion spring has one end wedged in an aperture formed through said stud.

12. In a musical instrument having at least one tone hole together with a pair of stationary posts disposed in spaced relation and being adapted for mounting of a key in pivotal relation to said tone hole, inner and outer tubular members, said key connected to said outer tubular member, a tensioning member within said inner tubular member operably connected for biasing said key in a normally closed relation with said tone hole, the improvement comprising:

said inner tubular member disposed substantially within said outer tubular member; and means mounting and securing said inner an outer tubular members for concurrent reciprocal rotation about a longitudinal axis between said posts.

13. In a musical instrument according to claim 12, wherein opposite ends of said inner tubular member are mounted for rotation by said posts.

14. In a musical instrument according to claim 13, wherein opposite ends of said inner tubular member are journalled for rotation within said posts.

15. In a musical instrument according to claim 12, wherein one end of said inner tubular member is mounted for rotation by one of said posts, and one end of said outer tubular member is mounted for rotation by another of said posts.

16. In a musical instrument according to claim 15, wherein said one end of said outer tubular member includes a central recess, and said another post includes a threaded stud having a pivot at least partially received in said central recess.

17. In a musical instrument according to claim 12, wherein one end of said inner tubular member is journalled for rotation about said longitudinal axis within a first one of said posts;

a stud received in said first one of said posts for adjustable rotation about an axis parallel to said longitudinal axis; and said tensioning member comprising a torsion spring having one end secured against relative rotation to said inner tubular member and an opposite end secured against relative rotation to said stud, whereby tension of said torsion spring may be adjusted by rotation of said stud.

18. In a musical instrument according to claim 12, further comprising means for constraining said inner and outer tubular members against relative rotation, while permitting relative axial movement of said inner and outer tubular members.

19. In a musical instrument according to claim 18, further comprising an axially extending groove in one of said inner and outer tubular members and a projection on the other of said inner and outer tubular members, said projection received in said groove.

20. In a musical instrument having at least one tone hole together with a pair of stationary posts disposed in spaced relation and being adapted for mounting of a key in pivotal relation to said tone hole, the combination comprising:

inner and outer tubular members, said key connected to said outer tubular member;

means mounting and securing said inner and outer tubular members for concurrent reciprocal rotation about a longitudinal axis between said posts, and allowing relative axial movement between said inner and outer tubular members;

one end of said inner tubular member supported for rotation about said longitudinal axis by a first one of said posts;

a stud mounted for adjustable rotation by said first one of said posts about an axis parallel to said longitudinal axis; and a torsion spring substantially within said inner tubular member operably connected for biasing said key in a normally closed relation with said tone hole, said torsion spring having one end secured against relative rotation to said inner tubular member and an opposite end secured against relative rotation to said stud, whereby tension of said torsion spring may be adjusted by rotation of said stud.

* * * * *